US010106949B2

(12) United States Patent
van Amelsfoort et al.

(10) Patent No.: US 10,106,949 B2
(45) Date of Patent: Oct. 23, 2018

(54) COUPLER FOR AN IMPLEMENT ASSEMBLY

(71) Applicant: Caterpillar Work Tools B.V., s-Hertogenbosch (NL)

(72) Inventors: Eduard van Amelsfoort, Tilburg (NL); Henricus Dings, Kerkdriel (NL)

(73) Assignee: Caterpillar Work Tools B.V., s-Hertogenbosch (NL)

( * ) Notice: Subject to any disclaimer, the term of this patent is extended or adjusted under 35 U.S.C. 154(b) by 0 days.

(21) Appl. No.: 15/461,802

(22) Filed: Mar. 17, 2017

(65) Prior Publication Data

US 2017/0268197 A1 Sep. 21, 2017

(30) Foreign Application Priority Data

Mar. 18, 2016 (GB) ..... 1604616.1

(51) Int. Cl.

| | |
|---|---|
| ***E02F 3/36*** | (2006.01) |
| *E02F 3/32* | (2006.01) |
| *E02F 3/34* | (2006.01) |
| *E02F 9/22* | (2006.01) |
| *E02F 9/28* | (2006.01) |

(52) U.S. Cl.

CPC ..... *E02F 3/3631* (2013.01); *E02F 3/3663* (2013.01); *E02F 3/32* (2013.01); *E02F 3/34* (2013.01); *E02F 9/2271* (2013.01); *E02F 9/2808* (2013.01); *E02F 9/2875* (2013.01)

(58) Field of Classification Search

CPC ..... E02F 3/3631

See application file for complete search history.

(56) References Cited

U.S. PATENT DOCUMENTS

| | | | | |
|---|---|---|---|---|
| 4,836,741 | A | 6/1989 | St. Louis et al. | |
| 5,494,396 | A | 2/1996 | Geier et al. | |
| 5,692,855 | A | 12/1997 | Burton | |
| 5,890,871 | A | 4/1999 | Woerman | |
| 6,231,296 | B1 * | 5/2001 | Blomgren | E02F 3/3631 37/468 |
| 6,487,800 | B1 | 12/2002 | Evans et al. | |
| 7,564,019 | B2 | 7/2009 | Olsen et al. | |
| 7,690,880 | B2 | 4/2010 | Honeyman et al. | |
| 8,469,623 | B2 | 6/2013 | Luyendijk et al. | |
| 2001/0051093 | A1 * | 12/2001 | Riccardi | E02F 3/3631 414/723 |
| 2006/0242865 | A1 * | 11/2006 | Herguido Fo | E02F 3/3613 37/468 |
| 2007/0201973 | A1 | 8/2007 | McDermott et al. | |

FOREIGN PATENT DOCUMENTS

| | | | | |
|---|---|---|---|---|
| AU | 2008243058 | B2 | 7/2011 | |
| DE | 202010003410 | U1 | 8/2011 | |
| EP | 1156161 | A2 * | 11/2001 | E02F 3/3631 |
| WO | WO 0037742 | A1 * | 6/2000 | |

* cited by examiner

*Primary Examiner* — Gerald McClain

(57) ABSTRACT

A coupler for detachably coupling to a work tool is provided. The coupler includes a frame with a first aperture formed therein. The first aperture extends along a first axis inclined with respect to a transverse axis of the frame. The coupler further includes a first locking member provided within the first aperture. The coupler also includes an actuator configured to move the first locking member between an unlocked position in which first locking member is disengaged from the work tool, and a locked position in which the first locking member is engaged with the work tool.

10 Claims, 10 Drawing Sheets

COUPLER FOR AN IMPLEMENT ASSEMBLY

TECHNICAL FIELD

The present disclosure relates generally to a coupler for an implement assembly and to an implement assembly including the coupler.

BACKGROUND

Couplers are commonly used for detachably connecting work tools, such as buckets, to work arms of primary movers, such as backhoes, excavators, or loaders. Couplers may allow a machine operator to quickly change from one work tool to another. Such couplers may be referred to as quick couplers.

The coupler may increase a distance between the work arm and the work tool, thereby reducing leverage applied to the work tool by the work arm. Where the work tool is a bucket, the increased moment arising from the increased distance may reduce the working capacity of the bucket for a given work arm. Hence, performance of the work tool may be affected.

Typically, a coupler is detachably connected to a work tool via a coupling device. The coupling device includes an actuator that selectively moves one or more locking pins into engagement with the work tool. However, during usage of the work tool, the locking pins may accidentally disengage from the work tool. Further, relative movement between the coupler and the work tool may increase wear of the locking pins and/or the work tool.

U.S. Pat. No. 6,231,296 relates to a device for coupling an implement to an operating arm of an excavator. The device includes a locking member with a hydraulic cylinder and a control unit for supplying the cylinder with an operating pressure. The hydraulic cylinder has two coaxial piston rods which extend to engage with corresponding openings provided in locking elements on the implement.

SUMMARY OF THE DISCLOSURE

In an aspect of the present disclosure, a coupler for detachably coupling to a work tool is provided. The coupler includes a frame with a first aperture formed therein. The first aperture extends along a first axis inclined with respect to a transverse axis of the frame. The coupler further includes a first locking member configured to move between an unlocked position in which the first locking member is substantially received within the first aperture, and a locked position in which the first locking member at least partially extends out of the first aperture.

In another aspect of the present disclosure, an implement assembly is provided. The assembly includes an arm, a work tool and a coupler pivotally mounted on the arm. The coupler further detachably couples the arm to the work tool. The coupler includes a frame with a first aperture formed therein. The first aperture extends at an angle with respect to a transverse axis of the frame. The coupler further includes a first locking member provided within the first aperture. The coupler also includes an actuator configured to move the first locking member between an unlocked position in which first locking member is disengaged from the work tool, and a locked position in which the first locking member is engaged with the work tool.

In yet another aspect of the present disclosure, a method for coupling a coupler to a work tool is disclosed. The coupler includes a first locking member. The method includes moving the first locking member along a first axis between an unlocked position in which first locking member is disengaged from the work tool, and a locked position in which the first locking member is engaged with the work tool. The first axis is inclined with respect to a transverse axis of the coupler.

DETAILED DESCRIPTION

Figure 1:
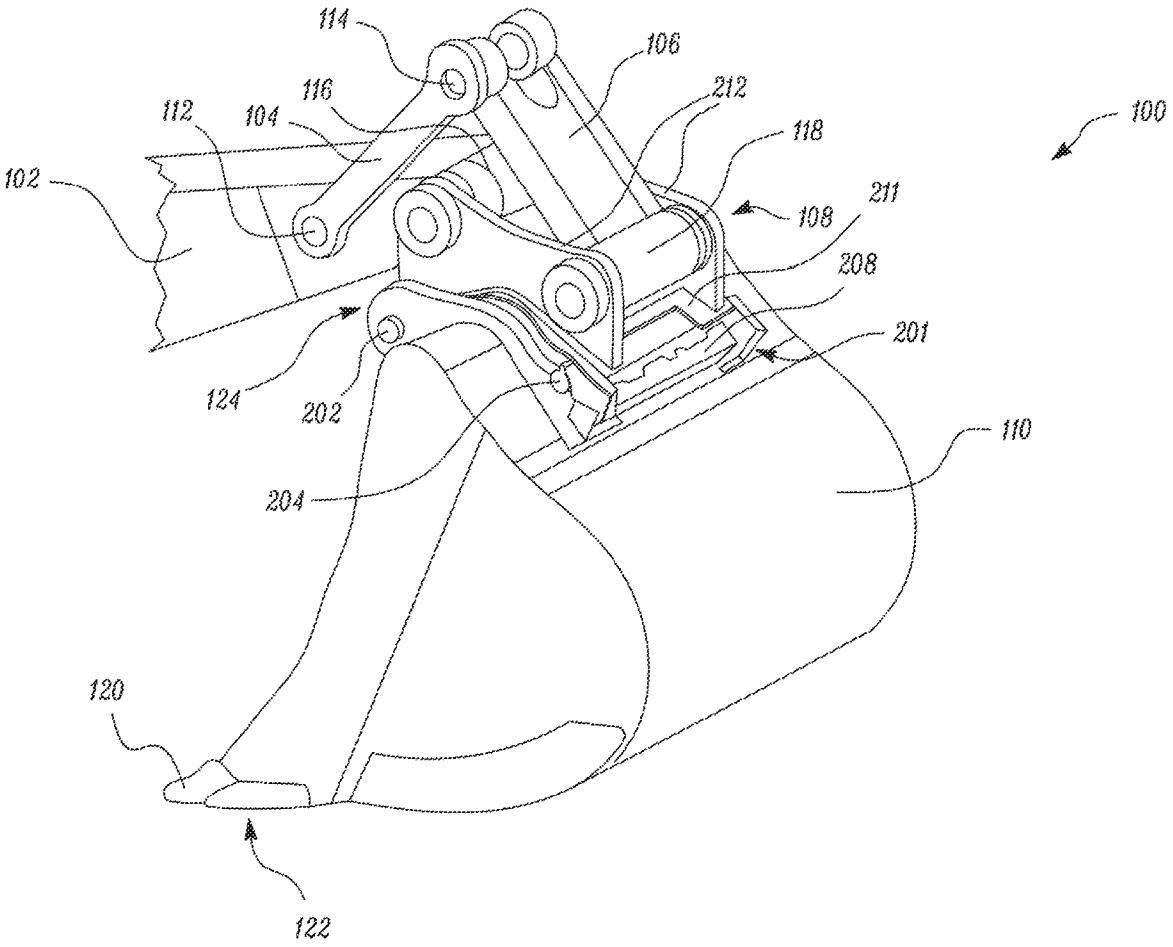
FIG. 1 is a partial perspective view of an implement assembly including a coupler and work tool according to a first embodiment of the present disclosure.

Wherever possible, the same reference numbers will be used throughout the drawings to refer to the same or the like parts. Referring to FIG. 1, an implement assembly 100 is illustrated. The implement assembly 100 includes an arm 102, a first link 104, a second link 106, a coupler 108 and a work tool 110. The arm 102 may be a work arm of a machine (not shown), for example, an excavator, backhoe, loader, or the like. The arm 102 may provide motive force to the work tool 110 via the coupler 108.

The first link 104 is pivotally connected to the arm 102 via a first pin joint 112. Further, a second pin joint 114 pivotally connects the first link 104 to the second link 106. A third pin joint 116 pivotally connects the arm 102 to the coupler 108, while a fourth pin joint 118 pivotally connects the second link 106 to the coupler 108. A machine actuator (not shown), such as a hydraulic cylinder, may be provided between the arm 102 and one of the links 104, 106 to provide additional actuation of the work tool 110 via the coupler 108, such as rotation of the coupler 108 and work tool 110 relative to the arm 102 about the third pin joint 116. In the illustrated embodiment, the work tool 110 is an excavating bucket having multiple excavating teeth 120 at a lower end 122. However, in alternative embodiments, the work tool 110 may be a ripper, a drill, and the like.

Figure 2:
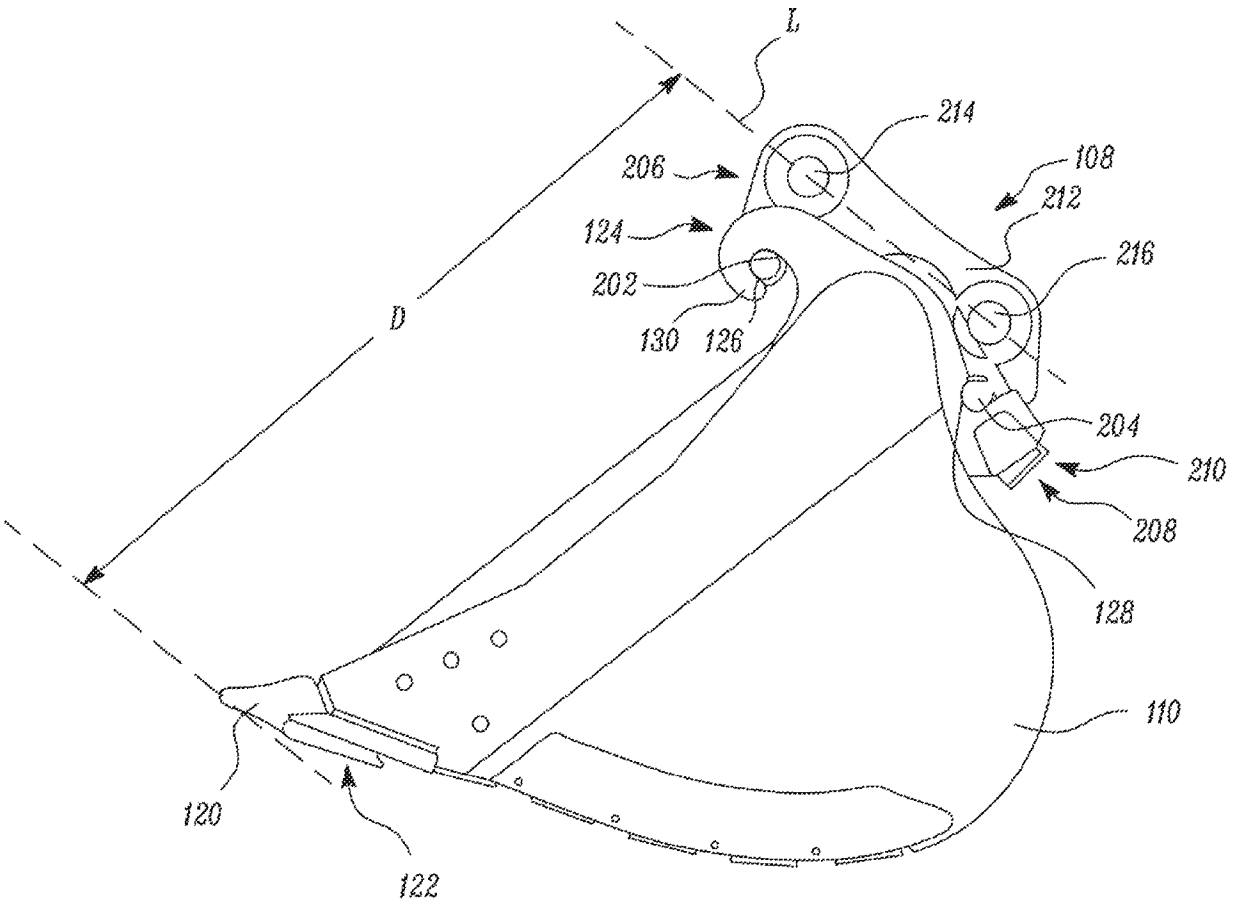
FIG. 2 is a partial side view of the coupler and work tool of FIG. 1.

Referring to FIGS. 1 and 2, the work tool 110 includes a connecting section 124 including a pair of first openings 126 (only one shown) and a pair of second openings 128 (only one shown). The connecting section 124 may be a separate component connected to the work tool 110 via various methods, such as welding, adhesives, brazing, bolting and the like. Alternatively, the connecting section 124 may be integral with the work tool 110. Each of the first openings 126 are defined in a hook 130 of the connecting section 124.

The coupler 108 includes a frame 201 comprising a base 211 and a pair of raised side portions 212 provided spaced apart at each side of the base 211. The frame 201 has a longitudinal axis 'L'. The frame 201 is configured to be received on the connecting section 124 of the work tool 110. The coupler 108 also includes a pair of first pin portions 202 (only one shown) extending from the frame 201 and configured to be at least partly received in corresponding first openings 126. Additionally, the coupler 108 includes a pair of second pin portions 204 (only one shown) extending from the frame 201 and configured to be at least partly received in corresponding second openings 128. The first pin portions 202 are disposed proximal to a first end 206 of the frame 201 and the second pin portions 204 are spaced from the first pin portions 202 with respect to the longitudinal axis 'L' of the frame 201. The coupler 108 further includes an actuator 208 disposed at a second end 210 of the frame 201 opposite to the first end 206. The coupler 108 may be detachably coupled to the connecting section 124 of the work tool 110 via the first and second pin portions 202, 204 and the actuator 208, as described in more detail below.

Each of the side portions 212 define a pair of first holes 214 (only one shown) and a pair of second holes 216 (only one shown). The first holes 214 receive the third pin joint 116 to connect the coupler 108 to the arm 102, while the second holes 216 receive the fourth pin joint 118 to connect the coupler 108 to the second link 106.

Since the actuator 208 is disposed at the second end 210 of the coupler 108, an offset 'D' between tips of the excavating teeth 120 at the lower end 122 of the work tool 110 and the third pin joint 116 may be reduced. Hence, a distance between the arm 102 and the work tool 110 may be reduced, resulting in increased leverage and improved performance of the implement assembly 100.

Figure 4:
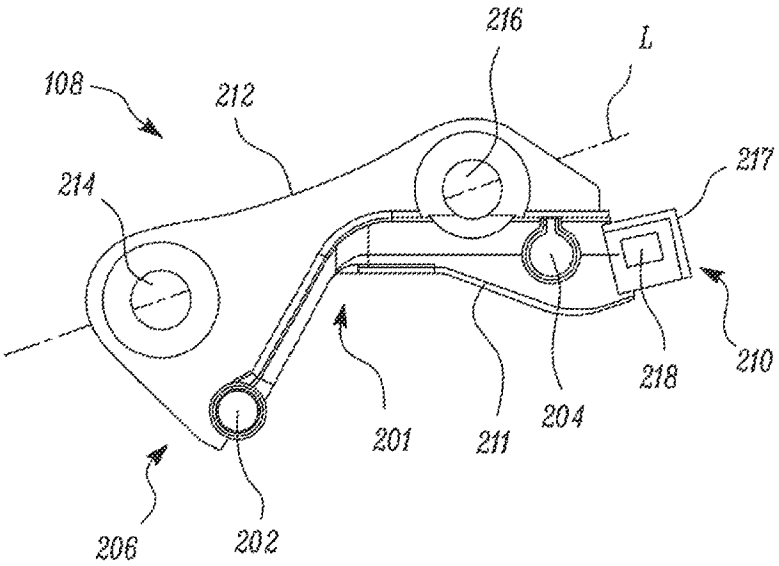
FIG. 4 is a side view of the coupler of FIG. 3.
Figure 3:
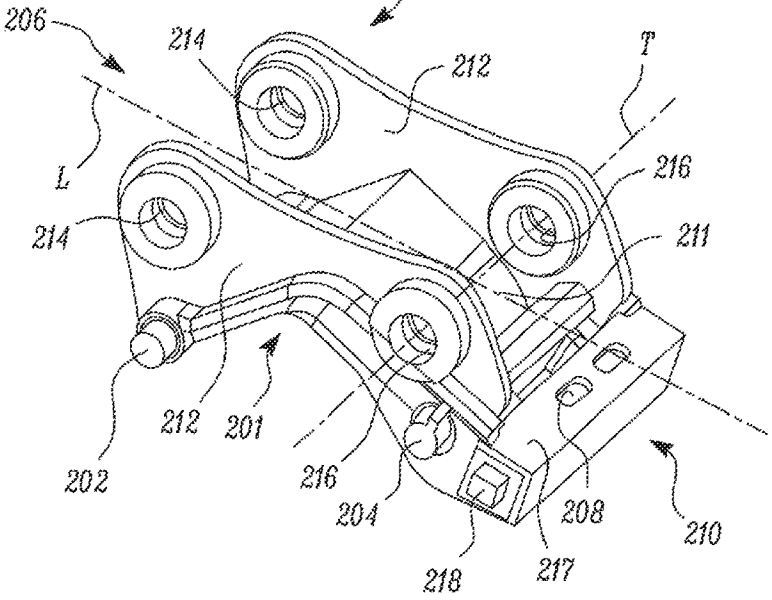
FIG. 3 is a perspective view of the coupler according to an embodiment of the present disclosure.

Referring to FIGS. 3 and 4, the coupler 108 includes a cover portion 217 at the second end 210 to partly enclose the actuator 208. Further, the side portions 212 are spaced from each other with respect to a transverse axis 'T' of the frame 201. The transverse axis 'T' may be generally perpendicular to the longitudinal axis 'L'. The coupler 108 further includes a first locking member 218 and a second locking member 220 (shown in FIG. 5A). The first and second locking members 218, 220 are selectively engaged with corresponding recesses (not shown) of the work tool 110 (shown in FIG. 2) in order to detachably connect the coupler 108 to the work tool 110. The first and second locking members 218, 220 are spaced along the transverse axis 'T' of the frame 201. The actuator 208 selectively moves each of the first and second locking members 218, 220 between an unlocked position (shown in FIGS. 5A and 6A) in which the first and second locking members 218, 220 are disengaged from the work tool 110, and a locked position (shown in FIGS. 5B and 6B) in which the first and second locking members 218, 220 are engaged with the work tool 110.

Figure 5B:
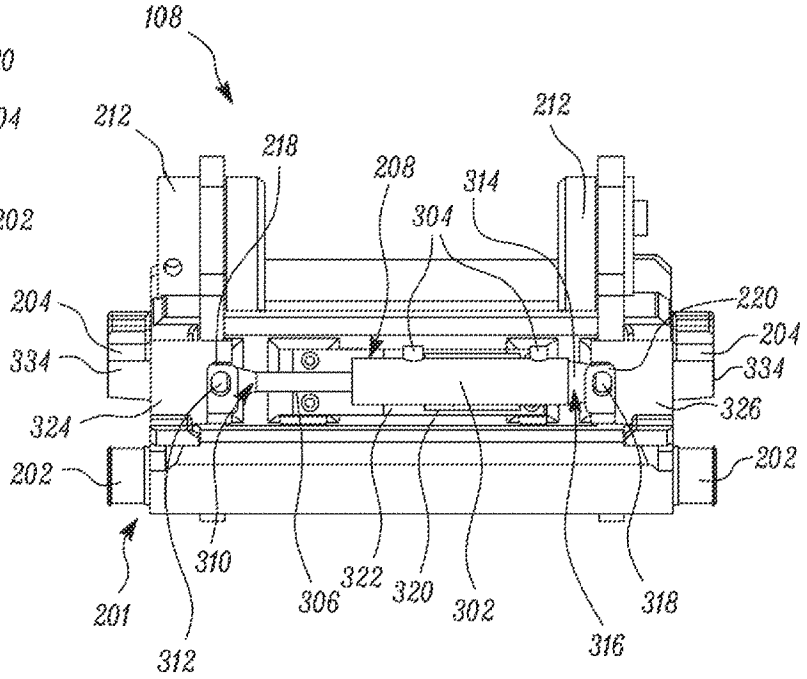
FIG. 5B is a rear view of the coupler of FIG. 5A with a locking member in a locked position.
Figure 5A:
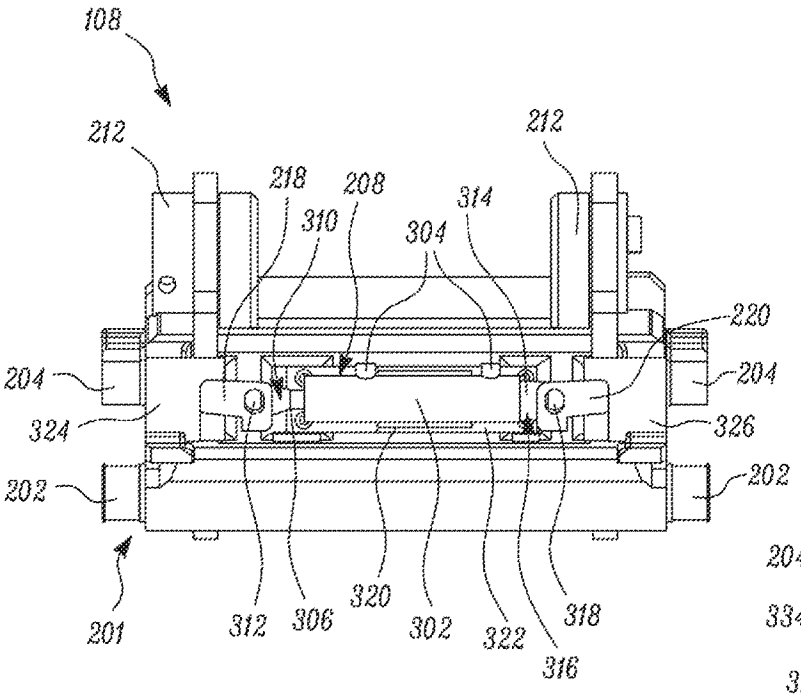
FIG. 5A is a rear view of the coupler with a cover portion removed and a locking member in an unlocked position according to an embodiment of the present disclosure.
Figures 6A, 6B:
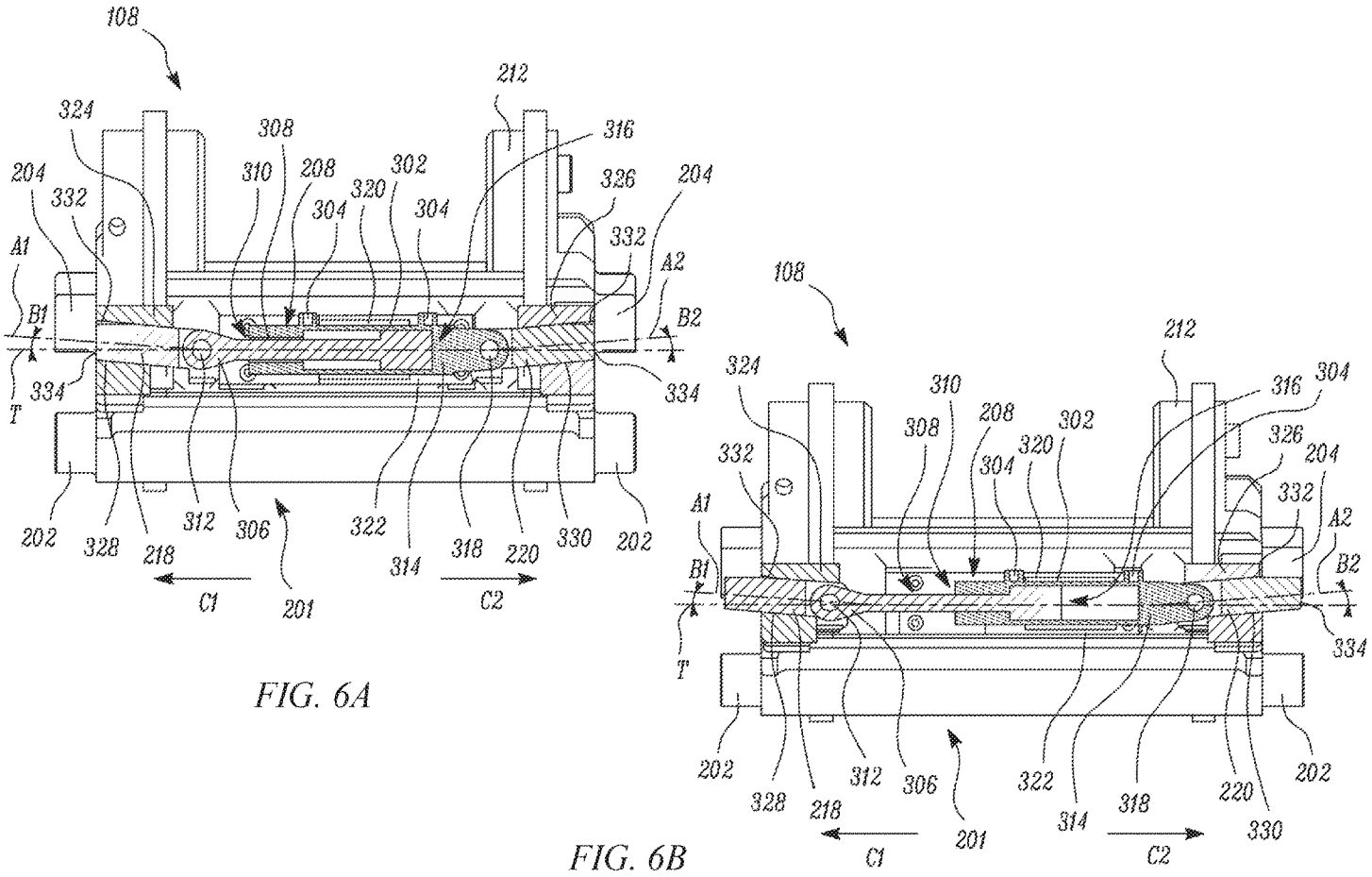
FIG. 6A is a rear sectional view of the coupler with the locking member in the unlocked position according to an embodiment of the present disclosure.
FIG. 6B is a rear sectional view of the coupler of FIG. 6A with the locking member in the locked position.

Referring to FIGS. 5A and 6A, the actuator 208 includes a casing 302 defining a pair of ports 304 and a rod 306 slidingly received within the casing 302. The casing 302 has an opening 308 at one end 310 through which the rod 306 extends. The rod 306 is pivotally connected to the first locking member 218 via a first pivot joint 312. Further, the casing 302 includes an extension 314 at a cylinder end 316 opposite to the one end 310. The extension 314 is pivotally connected to the second locking member 220 via a second pivot joint 318. The casing 302 is movable with respect to the frame 201 of the coupler 108, while the rod 306 is extendable and retractable with respect to the casing 302. In the illustrated embodiment, the casing 302 is coupled to a guiding member 320 which is slidable in a recess 322 of the frame 201. The guiding member 320 and the recess 322 may together guide a movement of the casing 302 with respect to the frame 201.

In an embodiment, the actuator 208 is a double-acting hydraulic cylinder with the ports 304 in fluid communication with a hydraulic system (not shown). The hydraulic system may include multiple components, such as one or more valves, fluid conduits, pumps, and fluid reservoirs. The hydraulic system may regulate flow of fluid to and from the casing 302 via the ports 304 in order to extend or retract the rod 306 with respect to the casing 302. The hydraulic system may be separate from the machine associated with the arm 102. Alternatively, the hydraulic system may be driven by a primary mover of the machine. Further, the hydraulic system may be automatically controlled and/or operator controlled. In other embodiments, the actuator 208 may be any other type of suitable actuator, for example, a worm drive arrangement.

The frame 201 further includes a first support portion 324 and a second support portion 326 spaced from each other with respect to the transverse axis 'T'. The first support portion 324 defines a first aperture 328 extending along a first axis 'A1'. The first axis 'A1' is inclined with respect to the transverse axis 'T' of the frame 201. The second support portion 326 defines a second aperture 330 extending along a second axis 'A2'. The second axis 'A2' is inclined with respect to the transverse axis 'T' of the frame 201. In the illustrated embodiment, the first axis 'A1' is inclined at a first angle 'B1' relative to the transverse axis 'T', while the second axis 'A2' is inclined at a second angle 'B2' relative to the transverse axis 'T'. In an embodiment, the first angle 'B1' may be substantially equal to the second angle 'B2'. In an alternative embodiment, the first angle 'B1' and the second angle 'B2' may have different values. In another embodiment, the first and second angles 'B1', 'B2' may lie in a range of about 2 degrees to 10 degrees. In a further embodiment, only one of the axes A1 and A2 may be inclined.

The first locking member 218 is movably received in the first aperture 328 such that the first locking member 218 moves along the first axis 'A1'. Similarly, the second locking member 220 is movably received in the second aperture 330 such that the second locking member 220 moves along the second axis 'A2'. Further, each of the first and second locking members 218, 220 also includes a chamfered section 332 at an end 334 which is receivable in the corresponding recesses of the work tool 110. In an alternative embodiment, only one of the first and second locking members 218, 220 may include the chamfered section 332. The chamfered section 332 may be substantially planar and parallel to the transverse axis 'T'.

In a retracted position of the rod 306, as shown in FIGS. 5A and 6A, the end 334 of each of the first and second locking members 218, 220 are located within the first and second apertures 328, 330, respectively. In an embodiment, the end 334 of each of the first and second locking members 218, 220 are substantially received within the first and second apertures 328, 330, respectively when in the retracted position. The hydraulic system may control flow of fluid to and from the casing 302 in order to move the rod 306, along a direction 'C1' to an extended position, as shown in FIGS. 5B and 6B. Due to the movement of the rod 306 along the direction 'C1', the casing 302 moves along a direction 'C2' generally opposite to the direction 'C1'. The movements of the rod 306 and the casing 302 also move the first and second locking members 218, 220, respectively. The first pivot joint 312 may enable the first locking member 218 to move along the first axis 'A1' and partially extend out of the first aperture 328. Similarly, the second pivot joint 318 may enable the second locking member 220 to move along the second axis 'A2' and partially extend out of the second aperture 330. Hence, the first and second locking members 218, 220 may engage with the corresponding recesses 1132 of the work tool 110, with the chamfered section 332 also contacting the coupling recesses 1132. This may result in a downward force on the coupler 108 and eliminate any spill between the second pin portions 204 and second opening 128, which may result in a more secure connection of the coupler 108 to the work tool 110.

In order to disengage the first and second locking members 218, 220 from the work tool 110, the hydraulic system may further regulate flow of fluid to and from the casing 302 and move the rod 306, in the direction 'C2', to the retracted position. As a result, the casing 302 may move in the direction 'C1'. Due to movements of the rod 306 and the casing 302, the ends 334 of the first and second locking members 218, 220 may move within the first and second apertures 328, 330, respectively. Hence, the first and second locking members 218, 220 may be disengaged from the corresponding recesses of the work tool 110.

In order to connect the coupler 108 with the work tool 110, the first pin portions 202 of the coupler 108 may be first engaged with the first openings 126 of the work tool 110. The coupler 108 may be moved by the arm 102, and the first and second links 104, 106 during connection with the work tool 110. The coupler 108 may be then rotated about the first pin portions 202 such that the second pin portions 204 are engaged with the second openings 128. Thereafter, the hydraulic system may cause the actuator 208 to move the first and second locking members 218, 220 into engagement with the work tool 110.

In order to disconnect the coupler 108 from the work tool 110, the hydraulic system may first cause the actuator 208 to disengage the first and second locking members 218, 220 from the work tool 110. The coupler 108 may be then rotated about the first pin portions 202 in order to remove the second pin portions 204 from the second openings 128. Thereafter, the coupler 108 may be moved such that the first pin portions 202 are disengaged from the first openings 126.

A second embodiment of the disclosure is shown if FIGS. 7 to 12, with like reference numerals denoting like parts to those of the first embodiment.

Figure 7:
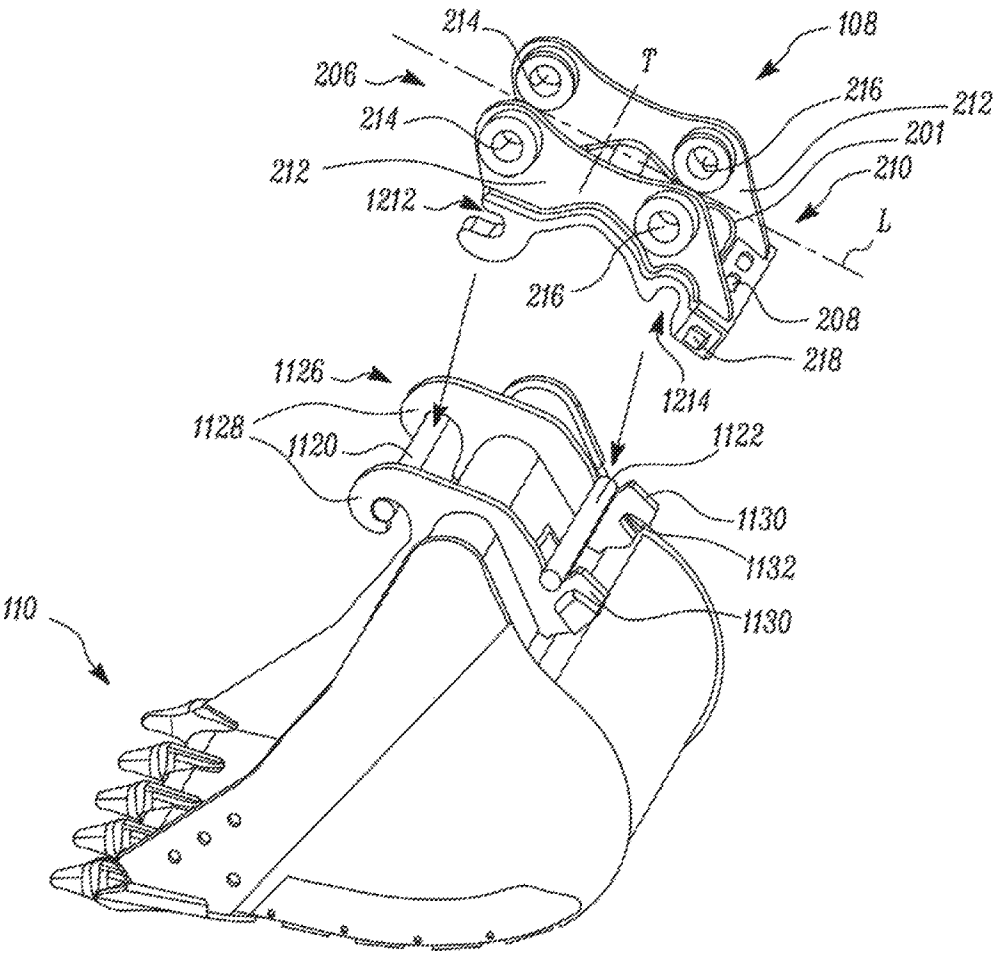
FIG. 7 is a partial exploded view of an assembly including a coupler, according to a second embodiment of the present disclosure.

Referring to FIG. 7, the work tool 110 of the second embodiment includes a connecting section 1126 including a pair of hooks 1128 and a pair of second hooks 1130. The first hooks 1128 receive the first pin member 1120, while the second hooks 1130 receive the second pin member 1122. In an embodiment, the first pin member 1120 and the second pin member 1122 may be coupled to the first hooks 1128 and the second hooks 1130, respectively, by various methods, such as welding, adhesives, brazing, and the like. In an alternative embodiment, the first and second pin members 120, 122 may be integral with the work tool 110. The work tool 110 further defines a pair of coupling recesses 1132 (only one shown in FIG. 7) configured to be detachably coupled to the coupler 108 via locking members 218, 220. The arrangement of the locking members 218, 220, and associated apertures 328, 330 and actuator 208 in this embodiment are of the same form as that described above in relation to the first embodiment and shown in FIGS. 6A and 6B.

The frame 201 of this embodiment defines a pair of first recesses 1212 (only one shown in FIG. 7) at the first end 206. The first recesses 1212 are spaced apart from each other along the transverse axis 'T'. The frame 201 also defines a pair of second recesses 1214 (only one shown in FIG. 7) spaced from the first recesses 1212. The second recesses 1214 are also spaced apart from each other along the transverse axis 'T'. The first recesses 1212 at least partially receive the first pin member 1120, while the second recesses 1214 at least partially receive the second pin member 1122. The actuator 208 is configured to retract and extend a pair of locking members 218, 220 (only one shown in FIG. 7) into corresponding coupling recesses 1132 of the work tool 110. The coupler 108 also includes a securing system 1302 (shown in FIG. 8) configured to detachably secure the first pin member 1120 to the frame 201. Details of the securing system 1302 will be described hereinafter in greater detail.

Figure 9:
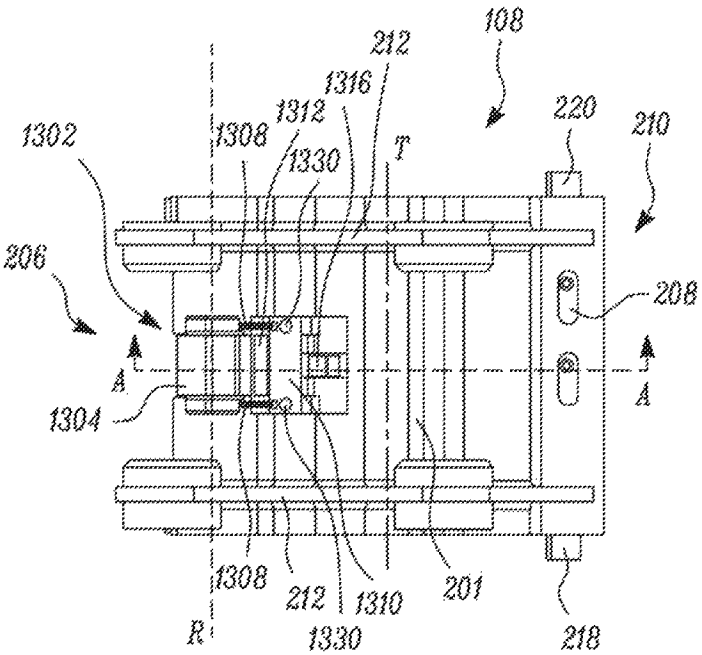
FIG. 9 is a top view of the coupler of FIG. 7.
Figure 8:
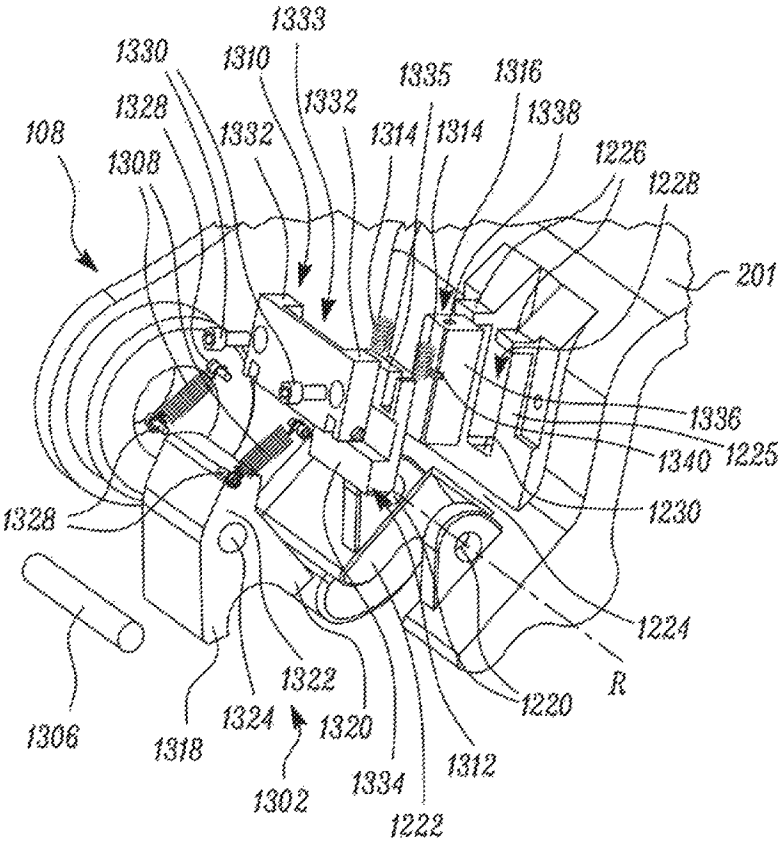
FIG. 8 is a partial exploded view of the coupler of FIG. 7.

Referring to FIGS. 7 to 9, the securing system 1302 includes a retaining member 1304, a pin element 1306, a pair of first biasing members 1308, a guide member 1310, a lock member 1312, a pair of second biasing members 1314, and a second actuator 1316. The retaining member 1304 includes a first jaw 1318, a second jaw 1320 and a protrusion 1322. The first and second jaws 1318, 1320 partly receives the first pin member 1120 therebetween. The retaining member 1304 further defines a pin opening 1324 which partly receives the pin element 1306. The pin element 1306 is partly received within holes 1220 defined on the frame 201 to rotatably couple the retaining member 1304 to the frame 201. The retaining member 1304 is therefore rotatable with respect to the frame 201 about a rotation axis 'R'.

The frame 201 also includes a first stop portion 1222 and a second stop portion 1224. The first stop portion 1222 is configured to abut the second jaw 1320 to define a first position (shown in FIG. 10B) of the retaining member 1304, while the second stop portion 1224 is configured to abut the protrusion 1322 to define a second position (shown in FIG. 10A) of the retaining member 1304. Hence, the first and second stop portions 1222, 1224 limit the rotation of the retaining member 1304 between the first and second positions. The retaining member 1304 further defines a biasing opening 1326 (shown in FIG. 10A) configured to receive biasing fasteners 1328. The biasing fasteners 1328 couple the first biasing members 1308 to the retaining member 1304 and the guide member 1310. The first biasing members 1308 are configured to bias the retaining member 1304 to the second position. In the illustrated embodiment, the first biasing members 1308 are coil springs. However, the first biasing members 1308 may be any other resilient element, such as air springs, volute springs, and the like.

The guide member 1310 is coupled to the frame 201 via fasteners 1330. The guide member 1310 also includes a pair of guiding portions 1332 which define a volume 1333 therebetween. The lock member 1312 is slidably received in the volume 1333. Further, the lock member 1312 is movably received on a support portion 1225 of the frame 201. The lock member 1312 includes a projection 1334 configured to abut the protrusion 1322 of the retaining member 1304 in a locked position (shown in FIG. 10B) and an extension 1335. The guide member 1310 may guide a linear movement of the lock member 1312 between the locked position and an unlocked position (shown in FIG. 10A). The guide member 1310 may also protect various components, such as the lock member 1312 and the second actuator 1316, from dust and moisture. Moreover, the second biasing members 1314 are received between the lock member 1312 and tabs 1226 of the frame 201. The second biasing members 1314 are configured to bias the lock member 1312 to the locked position. In the illustrated embodiment, the first biasing members 1308 are coil springs. However, the first biasing members 1308 may be any other resilient element, such as air springs, volute springs, and the like.

The second actuator 1316 is movably received within an actuator recess 1228 of the frame 201. The second actuator 1316 includes a casing 1336 defining an inlet port 1338 and a slot 1340. The slot 1340 is configured to be engaged with the extension 1335 of the lock member 1312 such that the second actuator 1316 is coupled to the lock member 1312. The second actuator 1316 may be a hydraulic actuator operatively connected to the hydraulic system associated with the actuator 208. In an embodiment, the second actuator 1316 may be a single acting hydraulic cylinder. However, in an alternative embodiment, the second actuator 1316 may be any linear actuator.

Figure 10B:
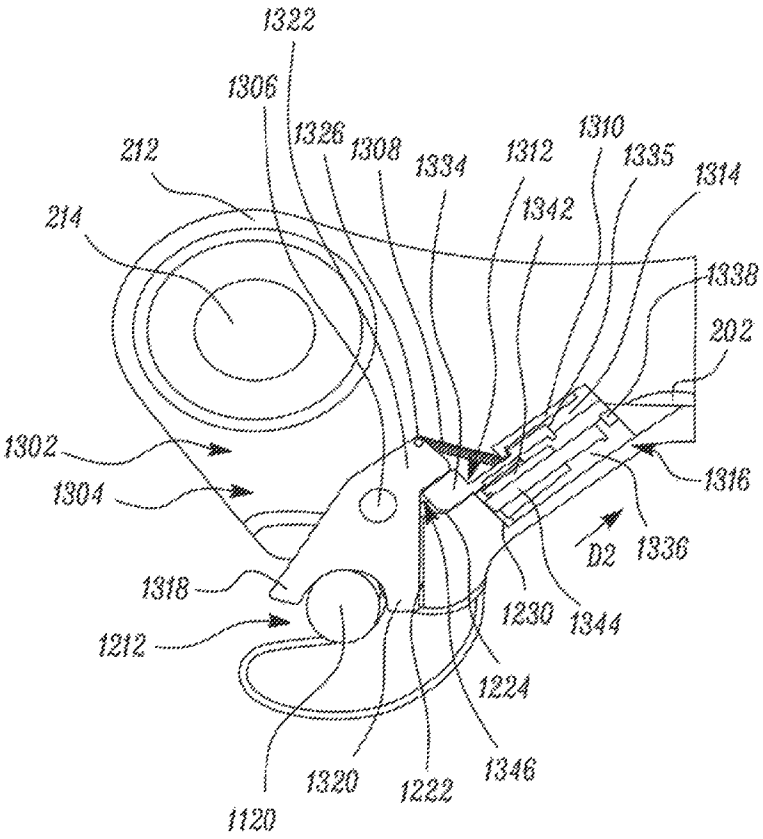
FIG. 10B is a partial sectional view of the coupler with the retaining member in a first position.
Figure 10A:
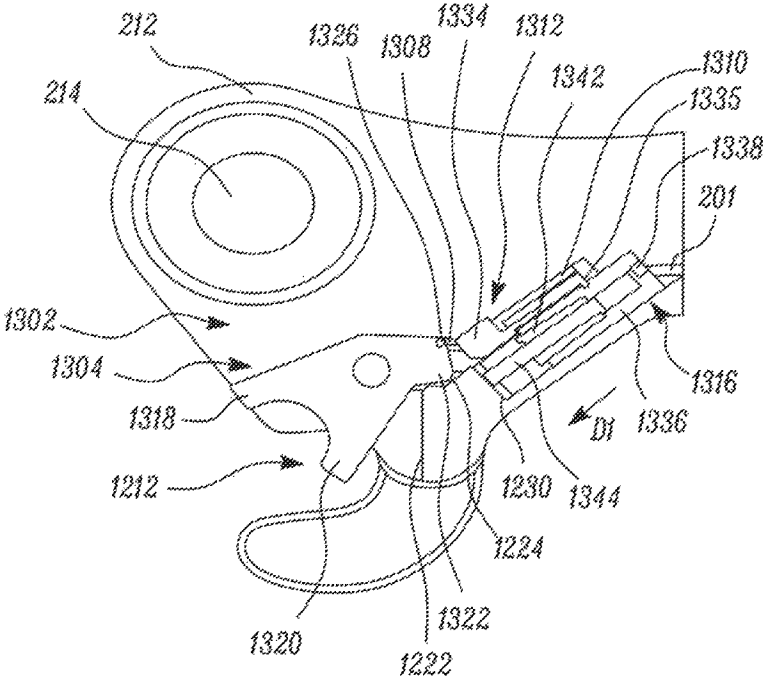
FIG. 10A is a partial sectional view of the coupler taken along line A-A of FIG. 9 with a retaining member in a second position.

Referring to FIG. 10A, the second actuator 1316 further includes a sealing member 1342 configured to seal an end opposite to the inlet port 1338, and a rod member 1344 slidably received through the sealing member 1342. The rod member 1344 abuts a wall 1230 of the actuator recess 1228 to support the second actuator 1316 and the lock member 1312 in the unlocked position against the biasing of the second biasing members 1314. Further, in the second position, the protrusion 1322 of the retaining member 1304 abuts the second stop portion 1224 and is disengaged from the first pin member 1120 (shown in FIG. 7). The first biasing members 1308 also bias the retaining member 1304 to the second position.

Referring to FIG. 10B, the retaining member 1304 rotates to the first position and holds the first pin member 1120 (shown in dotted lines) within the first recesses 1212. In an embodiment, the retaining member 1304 may rotate to the first position by self-weight when the frame 201 is tilted during assembly with the work tool 110 (shown in FIG. 7). The first stop portion 1222 abuts the second jaw 1320 to limit the rotation of the retaining member 1304 to the first position. As the retaining member 1304 rotates to the first position, the protrusion 1322 of the retaining member 1304 is spaced from the second stop portion 1224. Due to biasing of the second biasing members 1314, the lock member 1312 moves linearly to the locked position in a direction 'D1' such that the projection 1334 is received within a space 1346 between the protrusion 1322 and the second stop portion 1224. The projection 1334 of the lock member 1312 abuts the protrusion 1322 and retains the retaining member 1304 in the first position against the biasing of the first biasing members 1308. Hence, the retaining member 1304 may secure the coupler 108 to the first pin member 1120.

In order to disengage the retaining member 1304 from the first pin member 1120, the hydraulic system may introduce fluid into the casing 1336 of the second actuator 1316 via the inlet port 1338. A pressure of fluid may move the casing 1336 relative to the rod member 1344 in a direction 'D2' opposite to the direction 'D1'. As a result, the lock member 1312 also moves in the direction 'D2' to the unlocked position against the biasing of the second biasing members 1314. The projection 1334 moves out of the space 1346, and the first biasing members 1308 rotate the retaining member 1304 to the second position, thereby disengaging the retaining member 1304 from the first pin member 1120.

Figure 11C:
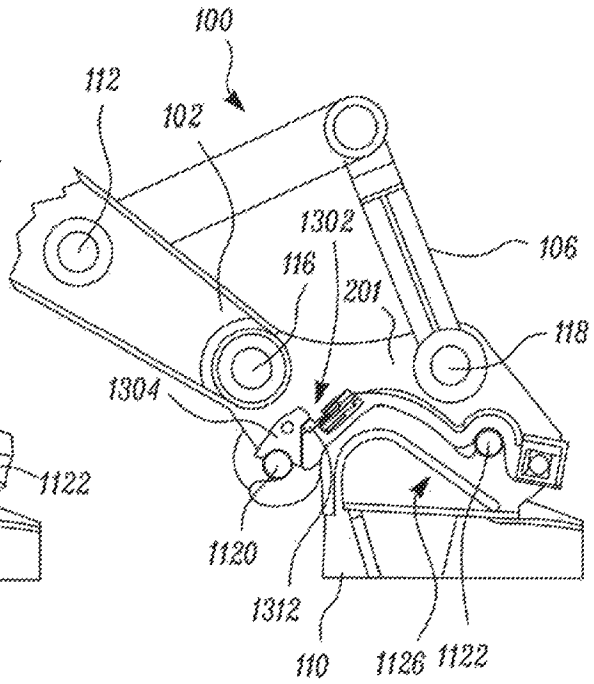
FIGS. 11A to 11C are partial sectional views illustrating an exemplary connection process of the assembly.

An exemplary connection process of the work tool 110 with the coupler 108 of the second embodiment will be now described with reference to FIGS. 11A to 11C. As illustrated in FIG. 11A, the coupler 108 may be first moved proximal to the connecting section 1126 of the work tool 110 such that the first recesses 1212 are aligned with the first pin member 1120. Initially the retaining member 1304 is in the second position and the lock member 1312 is in the unlocked position.

Figure 11B:
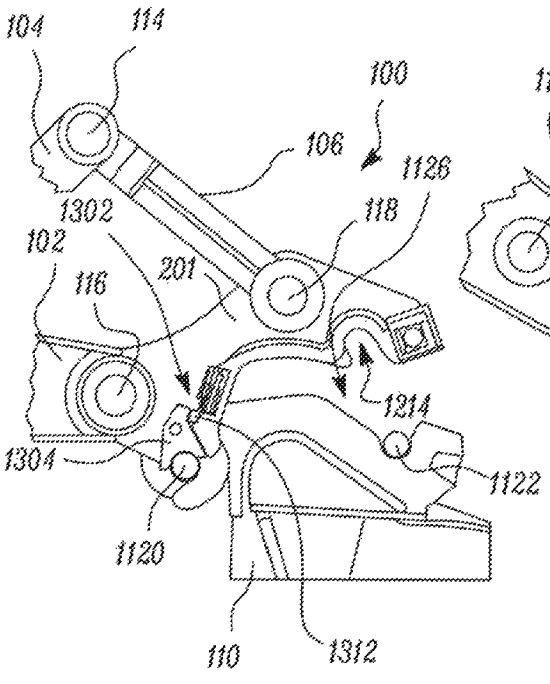
Figure 11A:
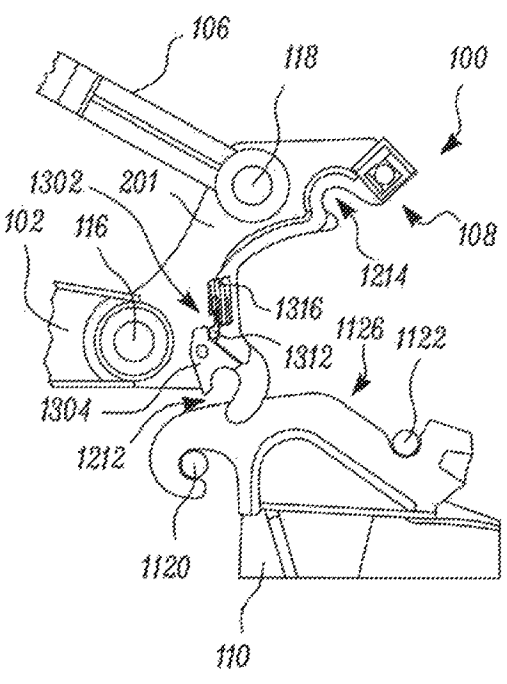

As illustrated in FIG. 11B, the coupler 108 may be tiled via the arm 102, and the first and second links 104, 106 such that the first recesses 1212 may be moved and coupled with the first pin member 1120. Moreover, due to tilting of the coupler 108, the retaining member 1304 may rotate to the first position by self-weight and engages the first pin member 1120. The lock member 1312 may move to the locked position and holds the retaining member 1304 in the first position. Hence, the work tool 110 may be secured to the coupler 108 before the actuator 208 is actuated. The coupler 108 may be then safely rotated about the first pin member 1120 without any accidental disconnection or misalignment between the first pin member 1120 and the coupler 108.

As illustrated in FIG. 11C, the second recesses 1214 may be coupled to the second pin member 1122. Subsequently, the hydraulic system may actuate the actuator 208 such that the locking members 218, 220 (shown in FIG. 7) are extended into the coupling recesses 1132 (shown in FIG. 7). The work tool 110 may be then connected securely to the coupler 108.

During a disconnection process, the hydraulic system may actuate the actuator 208 such that the locking members 218, 220 are retracted into apertures 328, 330 respectively to decouple the locking members 218, 220 from the coupling recesses 1132 of the work tool 110. However, the securing system 1302 may secure the coupler 108 to the first pin member 1120 after detachment of the locking members 218, 220 from the work tool 110. As a result, the coupler 108 may be safely rotated such that the second recesses 1214 are disengaged from the second pin member 1122. The hydraulic system may then actuate the second actuator 1316 to move the lock member 1312 to the unlocked position. The coupler 108 may be subsequently moved away from the first pin member 1120 such that the retaining member 1304 is free to rotate to the second position due to the biasing of the first biasing members 1308 (shown in FIG. 11A). Therefore, the coupler 108 is completely disconnected from the work tool 110.

INDUSTRIAL APPLICABILITY

A machine includes a work tool detachably coupled to a moving arm. A coupler is used to form the detachable connection between the work tool and the moving arm. The coupler may increase a distance between the moving arm and the work tool. The coupler also includes an actuator that selectively moves one or more locking members into engagement with the work tool. However, during usage of the work tool, the locking members may accidentally disengage from the work tool. Further, relative movement between the coupler and the work tool may increase wear of the locking members and/or the work tool.

The present disclosure is related to the implement assembly 100 including the coupler 108. The coupler 108 includes the actuator 208 that moves the first and second locking members 218, 220 within the first and second apertures 328, 330, respectively, in order to engage with or disengage from the work tool 110. The first and second apertures 328, 330 enable the first and second locking members 218, 220 to move along the first and second axes 'A1', 'A2', respectively. During engagement, the orientations of the first and second axes 'A1', 'A2' with respect to the transverse axis 'T' may cause upward movements of the first and second locking members 218, 220 within the corresponding recesses of the work tool 110. The first and second locking members 218, 220 may experience transverse forces along the transverse axis 'T'. Since, the first and second axes 'A1', 'A2' are inclined with respect to the transverse axis 'T', part of the transverse forces may be directed to and absorbed by the first and second support portions 324, 326 and the work tool 110. Therefore, the first and second locking members 218, 220 may offer improved resistance to transverse forces. This may result in a secure connection between the coupler 108 and the work tool 110 and prevent accidental disengagement of the coupler 108 from the work tool 110. Further, play between the work tool 110 and the coupler 108 may be substantially eliminated, thereby reducing wear of the first and second locking members 218, 220 and/or the work tool 110. The chamfered section 332 of each of the first and second locking members 218, 220 may further reduce wear and increase life of the coupler 108.

The actuator 208, the first and second locking members 218, 220, and the first and second apertures 328, 330 are located at the second end 210 of the frame 201 of the coupler 108. Further, the second pin portions 204 and the second holes 216 are spaced from the second end 210 of the frame 201. This may allow the first and second holes 214, 216 to be located closer to the base 211, thereby reducing the offset 'D' between the work tool 110 and the arm 102. Moreover, the actuator 208 is arranged along the transverse axis 'T' instead of along the longitudinal axis 'L'. This may enable a compact arrangement of the coupler 108 without the actuator 208 affecting the spacing between the second holes 216 and the base 211. Therefore, the offset 'D' may be reduced without any interference from the actuator 208. Due to the reduction in the offset 'D', a leverage applied by the arm 102 on the work tool 110 may increase and performance of the implement assembly 100 may improve.

The connection and disconnection processes, as described above, are purely exemplary in nature and may vary based on different machines and work tools. Further, the connection and disconnection process may be automatically or manually controlled.

Figure 12:
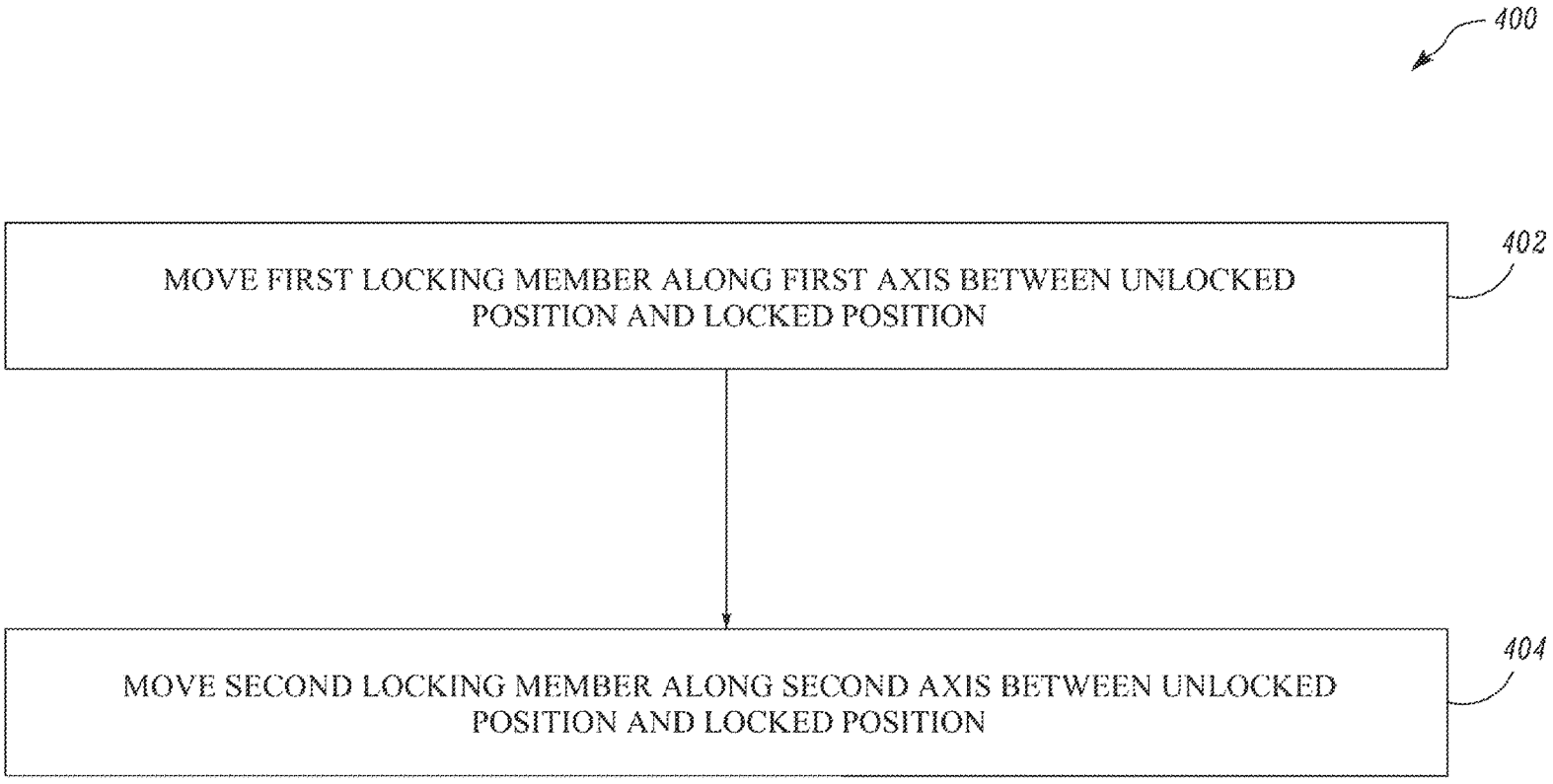
FIG. 12 illustrates a flowchart for a method of coupling the coupler to the work tool, according to an embodiment of the present disclosure.

With reference to FIG. 12, the present disclosure is also related to a method 400 of coupling the coupler 108 to the work tool 110. At step 402, the method 400 includes moving, via the actuator 208, the first locking member 218 along the first axis 'A1' between the unlocked position in which the first locking member 218 is disengaged from the work tool 110, and a locked position in which the first locking member 218 is engaged with the work tool 110. At step 404, the method 400 further includes moving, via the actuator 208, the second locking member 220 along the second axis 'A2' between the unlocked position in which the first locking member 220 is disengaged from the work tool 110, and a locked position in which the second locking member 220 is engaged with the work tool 110.

While aspects of the present disclosure have been particularly shown and described with reference to the embodiments above, it will be understood by those skilled in the art that various additional embodiments may be contemplated by the modification of the disclosed systems and methods without departing from the spirit and scope of what is disclosed. Such embodiments should be understood to fall within the scope of the present disclosure as determined based upon the claims and any equivalents thereof.

What is claimed is:

1. A coupler for detachably coupling to a work tool, the coupler comprising:

a frame with a first aperture formed therein, the first aperture extending along a first axis inclined with respect to a transverse axis of the frame;

a first locking member moveable between an unlocked position in which first locking member is substantially received within the first aperture, and a locked position in which the first locking member at least partially extends out of the first aperture;

wherein the first locking member translates in the direction of the first axis.

2. The coupler of claim 1, further comprising:

a second aperture formed in the frame spaced from the first aperture, the second aperture extending along a second axis inclined with respect to the transverse axis of the frame, and a second locking member moveable between an unlocked position in which second locking member is substantially received within the second aperture, and a locked position in which the second locking member at least partially extends out of the second aperture.

3. The coupler of claim 2, wherein first and second apertures are spaced along the transverse axis of the frame.

4. The coupler of claim 2, further comprising an actuator pivotally coupled to the first and second locking members at opposing ends thereof.

5. The coupler of claim 4, wherein the first aperture, the second aperture and the actuator are provided at one end of the frame.

6. The coupler of claim 2, wherein at least one of the first locking member and the second locking member has a chamfered section.

7. The coupler of claim 6, wherein the chamfered section is substantially planar and parallel to the transverse axis.

8. The coupler of claim 6, wherein the chamfered section abuts the work tool when at least one of the first locking member and the second locking member is engaged therewith.

9. The coupler of claim 2, wherein the first and second axes are inclined with respect to the transverse axis of the frame by an angle in the range of about 2 degrees to 10 degrees.

10. A method for coupling a coupler to a work tool, the coupler having a first locking member, the method comprising:

moving the first locking member in a direction of a first axis between an unlocked position in which the first locking member is disengaged from the work tool, and a locked position in which the first locking member is engaged with the work tool, wherein the first axis is inclined with respect to a transverse axis of the coupler.

* * * * *